US012006007B2

(12) United States Patent
Steinhour

(10) Patent No.: US 12,006,007 B2
(45) Date of Patent: Jun. 11, 2024

(54) CONNECTORS FOR INFLATABLE STRUCTURES

(71) Applicant: Dirk Steinhour, Lyle, WA (US)

(72) Inventor: Dirk Steinhour, Lyle, WA (US)

( * ) Notice: Subject to any disclaimer, the term of this patent is extended or adjusted under 35 U.S.C. 154(b) by 417 days.

(21) Appl. No.: 16/974,314

(22) Filed: Dec. 22, 2020

(65) Prior Publication Data

US 2022/0266952 A1 Aug. 25, 2022

Related U.S. Application Data

(60) Provisional application No. 62/974,860, filed on Dec. 24, 2019.

(51) Int. Cl.
*B63B 7/08* (2020.01)
*B63B 1/24* (2020.01)

(52) U.S. Cl.
CPC ..... *B63B 7/085* (2013.01); *B63B 1/242* (2013.01)

(58) Field of Classification Search
CPC ..... B63B 1/242; B63B 7/085
See application file for complete search history.

(56) References Cited

U.S. PATENT DOCUMENTS

| | | | | |
|---|---|---|---|---|
| 8,273,427 | B1 * | 9/2012 | Steinhour | B32B 3/08 428/36.1 |
| 9,174,709 | B2 * | 11/2015 | Ekstedt | B63B 32/66 |
| 10,683,075 | B2 * | 6/2020 | Schibli | B63B 34/20 |
| 2019/0106190 | A1 * | 4/2019 | Schibli | B63H 20/007 |
| 2019/0308709 | A1 * | 10/2019 | Kramer | B63B 32/10 |
| 2020/0031434 | A1 * | 1/2020 | Pouchkarev | B63B 32/66 |
| 2022/0089256 | A1 * | 3/2022 | Cannon | B63B 32/40 |
| 2022/0266952 | A1 * | 8/2022 | Steinhour | B63B 1/242 |

FOREIGN PATENT DOCUMENTS

| | | | | |
|---|---|---|---|---|
| CN | 103958340 B | * | 11/2017 | B63B 15/02 |
| DE | 60301247 T2 | * | 3/2006 | B63B 21/045 |
| EP | 4180316 A1 | * | 5/2023 | B63B 32/10 |
| WO | WO-2017008916 A1 | * | 1/2017 | B63B 32/51 |

* cited by examiner

*Primary Examiner* — S. Joseph Morano
*Assistant Examiner* — Jovon E Hayes

(57) ABSTRACT

The present invention is a connector for an inflatable member. A portion of the connector extends within an internal volume of the inflatable member to define a recess for accepting a structural connection. The connector has an air-impermeable surface that is configured to maintain integrity of the inflatable member to allow the internal volume to be pressurized when the connector is bonded to an opening in a surface of the inflatable member. The connector can optionally pass through the opposing surface or otherwise engage the opposing surface to enhance its structural properties.

17 Claims, 5 Drawing Sheets

CONNECTORS FOR INFLATABLE STRUCTURES

CROSS-REFERENCE TO RELATED APPLICATIONS

This application is a continuation-in-part of U.S. Provisional Patent Application Ser. No. 62/974,860 filed Dec. 24, 2019.

FIELD OF THE PRESENT INVENTION

The present invention relates generally to structure deriving a significant portion of its structural rigidity from one or more inflatable members and more particularly to connectors for securing inflatable members together or for securing other structural members to an inflatable member.

BACKGROUND OF THE INVENTION

Inflatable structures allow for portability and easy deployment. They are typically comprised of inflated members that are designed to bear structural loads. These members could be in the shape of planar panels, tubular cylinders, arches, or other shapes. Inflatable planar panels made using drop stitch membranes can be used as structures for, among other things, walls, floors, platforms, and roof members. They can also be used in many other applications, structural or otherwise, that require portability or rapid deployment like emergency shelters, flood and water barriers, construction, watercraft like surfboards and paddleboards, and military and aerospace applications, for example.

Using inflatable members to build structures potentially requires many different components to be joined together. There is not only a need to attach these panels to each other, but also to other components, equipment, and accessories. The components and accessories could need a multitude of different attachment points that would be load- and moment-bearing, as well as durable. The drawback of the inflatable panel is that any surface attachment points or joints are limited in the loads they can withstand because the material that is used in panel construction is typically soft, air-impermeable, rubber-coated fabric. Significant loads placed on these panels from attachments or otherwise would cause the soft surface to deform locally at the point of the load. Thus, there is very little resistance to larger loads, and the deformation of the surface would not allow for increased structural integrity of the attachment point, and thus the panel would be compromised as well.

As a non-limiting illustration, an inflatable panel configured as a surfboard, kiteboard or other similar watercraft offers a number of benefits, including portability and durability, but requires a suitable connection for a fin, sail or hydrofoil mast. Conventional attempts to mount fins to inflatable surfboards are done in one of two ways. First, keeping the inflatable panel intact and providing a mount that is entirely above the surface of the inflatable avoids penetration of the inflatable surface but leaves the bulk of the connection structure, the means that give the fin resistance to lateral loads, above the surface of the inflatable and in the path of the flowing water on the planing hull of the surfboard, creating extra drag. Alternatively, a "doughnut" hole may extend entirely through the inflatable with sidewalls similar to the panel edges that allows for a majority of the structure of the fin receptacle to be mounted below the surface of the inflatable within the void created in the panel. However, the connector is not exposed to the pressurized air of the internal volume of the inflatable. Due to the size and extent of the doughnut hole, the drawback of this technique is that it is too interruptive of the surrounding surface of the inflatable, due to the lack of inflatable structure supporting the area directly around the doughnut hole. A degree of compensation may be provided by covering the void surrounding the connector with a large plate on both sides of the doughnut hole. These plates are interconnected with the structural mount in a way that attempts to distribute the loads on the structural connector to the surrounding surface area of the inflatable structure, by bridging the hole and extending beyond the edges of the doughnut hole significantly. Since the doughnut hole needs to be large enough to feasibly construct it, and still get access to the area to fabricate and be durably sealed off, then in turn it requires that the covering plates be sizable enough to cover these large holes and extend far enough beyond the holes to interact with the surface of the inflatable meaningfully. This interrupts the surface of the inflatable in a much larger area than would be ideal, and these doughnut holes and resulting cover plates make it impossible to mount these structural connectors on or near the edges of the drop-stitch surfboards or other structures where they may be needed to be, for performance, or for connection to adjacent panels or structures.

Accordingly, what has been needed is a way to mount a structural connector on an inflatable member, such as a drop stitch panel or tubular structure, that does not suffer from these deficiencies. Desirably, most of the connector structure is located within the profile defined by the inflatable member, especially in the area around the connector, while reducing the disruption to the integrity of the surface of the inflatable member. Similarly, it is desirable for the connector to interact with the inflatable member more directly, without the need for the doughnut hole or cover plates, to create a more structurally rigid connection point with far less weight added to the structure. As will be detailed in the material below, this disclosure satisfies these and other needs.

SUMMARY OF THE INVENTION

This disclosure is directed to a connector for an inflatable member comprising a portion configured to extend within an internal volume of the inflatable member and define a recess for accepting a structural connection and an air-impermeable surface that is configured to maintain integrity of the inflatable member to allow the internal volume to be pressurized when the connector is bonded to an opening in a surface of the inflatable member.

This disclosure also includes an inflatable member with opposing surfaces that define an internal volume that can be pressurized with air. The inflatable member has a connector with at least a portion that extends within an internal volume of the inflatable member, wherein the connector defines a recess for accepting a structural connection and creates an air-impermeable surface that maintains integrity of the inflatable member when the internal volume is pressurized.

Still further, this disclosure includes a method for securing a structural element to an inflatable member. The method may involve forming an opening in a first surface of the inflatable member. A connector may be positioned through the opening such that a portion of the connector extends within an internal volume of the inflatable member and defines a recess for accepting the structural element. The connector may then be sealed to the surface of the inflatable member. The connector has an air-impermeable surface that is configured to maintain integrity of the inflatable member to allow the internal volume to be pressurized.

Further features and advantages will become apparent from the following and more particular description of the preferred embodiments of the invention, as illustrated in the accompanying drawing, and in which.

DETAILED DESCRIPTION OF THE INVENTION

Figure 1:
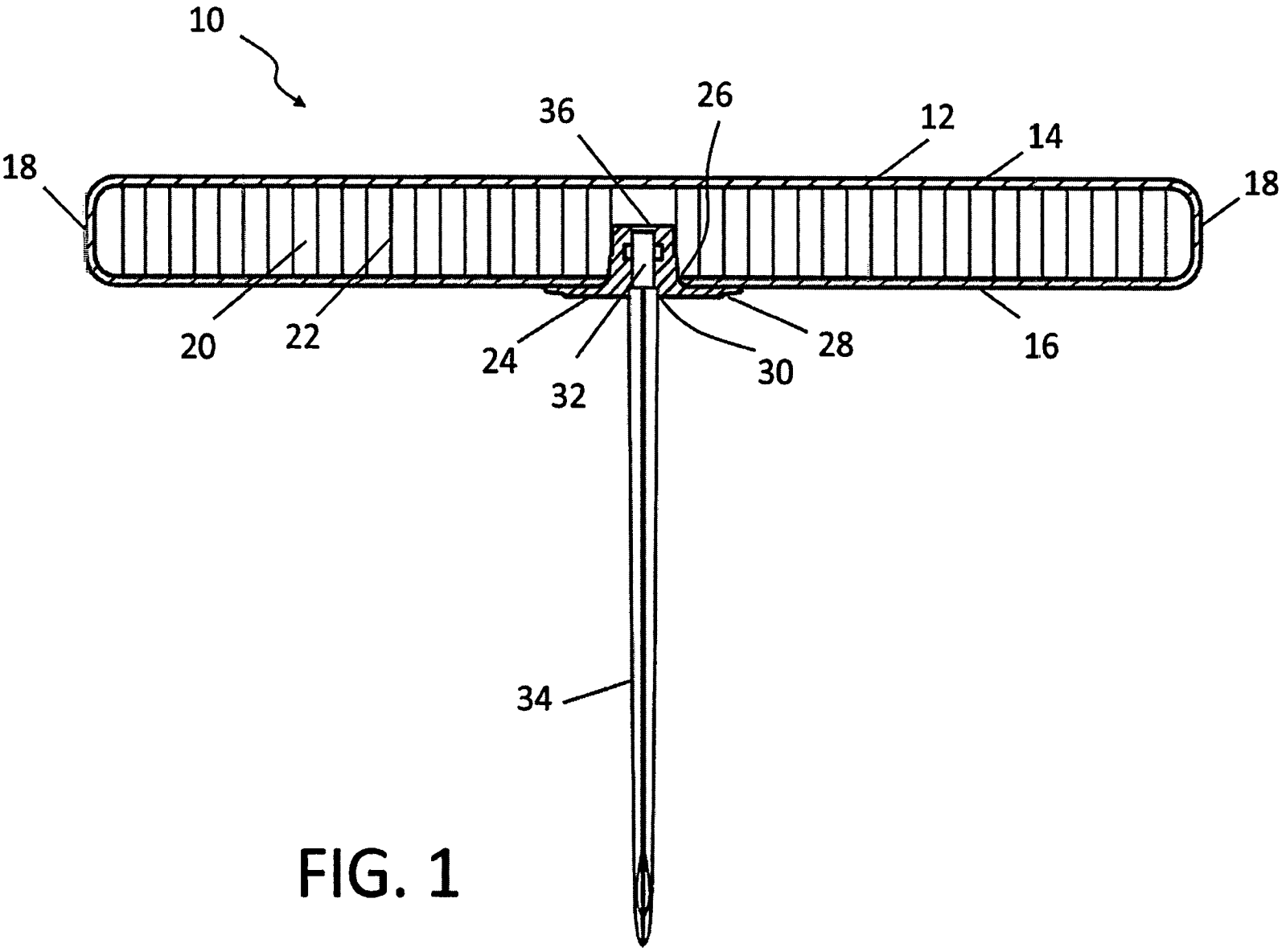
FIG. 1 is a cross-sectional schematic end view of an inflatable member with a connector according to the techniques of this disclosure.

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

As used in this specification and the appended claims, the term "modulus of elasticity" is meant to refer to (Young's) modulus, that is, the stiffness of a material.

As used in this specification and the appended claims, the term "stiffening sheet" is meant to refer to an anisotropic material formed by continuous high modulus fibers saturated with and embedded in a polymer matrix.

As used in this specification and the appended claims, the term "composite anisotropic material" is meant to refer to an anisotropic material formed by continuous high modulus fibers saturated with and embedded in a high modulus polymer matrix that is laminated to a flexible fabric or film.

Finally, as used in this specification and the appended claims, the singular forms "a, "an" and "the" include plural referents unless the content clearly dictates otherwise.

Inflatable structures are becoming more durable and manufacturable and, as a result, are in more common use. In many cases a drop-stitch construction is used to create panels and structures that have an air-pressurized structure of uniform thickness, and the opposing sides of the structure are generally parallel, but these panels can also be somewhat curved rather than completely flat. The internal volume of such an inflatable member is defined by its outer surfaces so that air can be added, typically through a valve, to pressurize the entire volume to impart the member with desired structural properties. The techniques of this disclosure are directed to connectors that allow for the securing of inflatable members amongst themselves or to other, non-inflatable structural elements. As such, a connector of this disclosure exhibits sufficient bearing surface and structure that it can transfer much higher loads into the drop stitch panel or between panels. Loads could be shear, torsional, compressive, or bending. In one aspect, the loads placed on the panel could be in the same plane as the panel, normal to the panel, or in any direction relative to the panel. Additionally, the attachment point could pass directly through or around the outer edge of the inflatable panel to simultaneously attach to the other side, allowing it to integrate with the surface on the other side and therefore increase the load capability many times over. In this way, the shear strength of the bearing surface is more than doubled, and the bearing surface area is increased substantially. This also significantly increases the bending and torsional loads that the attachment can withstand due to the separation of the two bearing points being equivalent to the thickness of the panel.

Some implementations of this disclosure relate to inflated watercraft built using drop stitch panels, including surfaces like those disclosed in commonly-owned U.S. Pat. No. 8,273,427 ("the '427 patent," which is hereby incorporated by reference in its entirety). As noted, there is a need to attach various objects to the top and/or bottom of a watercraft hull as well as a need to attach these structural panels together to form various hull shapes. For example, it is preferable to attach a fin (which in some cases experiences significant lateral force) to the watercraft in a way that would prevent the fin from deforming or deflecting under these lateral loads. The fin on inflatable watercraft is typically inserted into a fin box receptacle, a connector that is surface-mounted directly onto the drop stitch inflatable structure. However, a surface-mounted fin box connector necessitates that the bulk of the structural fin receptacle needs to sit on top of the surface of the hull, outside of the pressurized internal volume, creating excess drag. Further, a surface-mounted connector is not optimal because the fin is able to deflect easily under lateral loads because the material of the surface of the drop stitch membrane is non-rigid and flexible.

Accordingly, the techniques of this disclosure include connectors in which at least a portion of the connector is disposed within the profile formed by the pressurized internal volume. As will be appreciated, this reduces the drag as compared to a surface-mounted connector. The techniques of this disclosure also allow the connector to engage opposing surfaces of the inflatable member by passing through the inflatable section of the drop stitch membrane. Pursuant to this disclosure, the connector creates one or more seals with the inflatable surface(s) allowing some portion of the connector to be located within the profile established by the surfaces, such that the portion of the connector positioned within the internal volume is exposed to the pressurized internal volume. Similarly, the connector is formed from a material that is substantially impermeable to air so that sealing the connector to the surface membranes maintains the integrity of the internal volume and allows it to be pressurized relative to the surrounding atmosphere. As warranted, the connector can be configured to pass through the inflatable member and form seals with the opposing surfaces to have much higher resistance to bending and side loads due to the interaction with the opposite panel surface of the drop stitched watercraft hull. A further embodiment of this invention allows for the fin box attachment to utilize the improved stiffness properties of the thin composite sheets as defined in the '427 patent. This method displaces the loads to one or both surfaces over a larger area and integrates with a high strength composite skin material, which further improves the resistance to bending loads inherent with surfboard fins. Although described in the context of connecting a fin (or foil or sail mast) to an inflatable watercraft, it will be appreciated that the improved structural properties provided by the connectors of this disclosure can be used for securing other structural elements to any type of inflatable member or for securing multiple inflatable members together.

To help illustrate aspects of this disclosure, FIG. 1 is an end cross-sectional view of watercraft 10 that has a hull comprising an inflatable member 12. In particular, opposing surfaces 14 and 16 and sidewalls 18 may be formed from a suitable membrane having the desired characteristics, such as the anisotropic composite materials disclosed in the '427 patent. The membranes are substantially impermeable to air, allowing internal volume 20 to be pressurized to impart structure to inflatable member 12. Drop stitches 22 extend between opposing surfaces 14 and 16 to control the dimensions of inflatable member 12 and keep the opposing surfaces generally planar. Connector 24 is positioned at an opening 26 in surface 16, such that at least a portion of connector 24 extends through surface 16 and is disposed within internal volume 20 of inflatable member 12. Moreover, the portion of connector 24 extending inside inflatable member 12 is therefore exposed to the pressurized air when inflated. To maintain the integrity of the inflatable volume, the portion of connector 24 exposed to the pressurized internal volume is impermeable to air and a seal is created between connector 24 and surface 16. To facilitate the formation of the seal, connector 24 may have a flange portion 28 that overlaps and can be bonded to surface 16. This overlap also functions to distribute shear and other forces from connector 24 to surface 16 of inflatable member 12. When the surface is anisotropic as disclosed in the '427 patent, the dimensions of flange 28 can be asymmetrically tailored to preferentially transfer forces. Connector 24 defines a recess 30 that is configured to receive a projection of the element being connected. In this embodiment, fin tab 32 of fin 34 fits within recess 30 to be secured to inflatable member 12. A resulting characteristic of this configuration is that when fin 34 is secured by connector 24, a bending moment pivot point 36 is created at the end of connector 24 opposite the end of fin 34. Notably, pivot point 36 is above surface 16 and within volume 20 in contrast to conventional surface mounting techniques. As desired, connector 24 can extend to the interior side of opposing surface 14 and optionally bonded to that surface so that it is engaged without penetration, allowing forces to be transferred to both surfaces.

Figure 2:
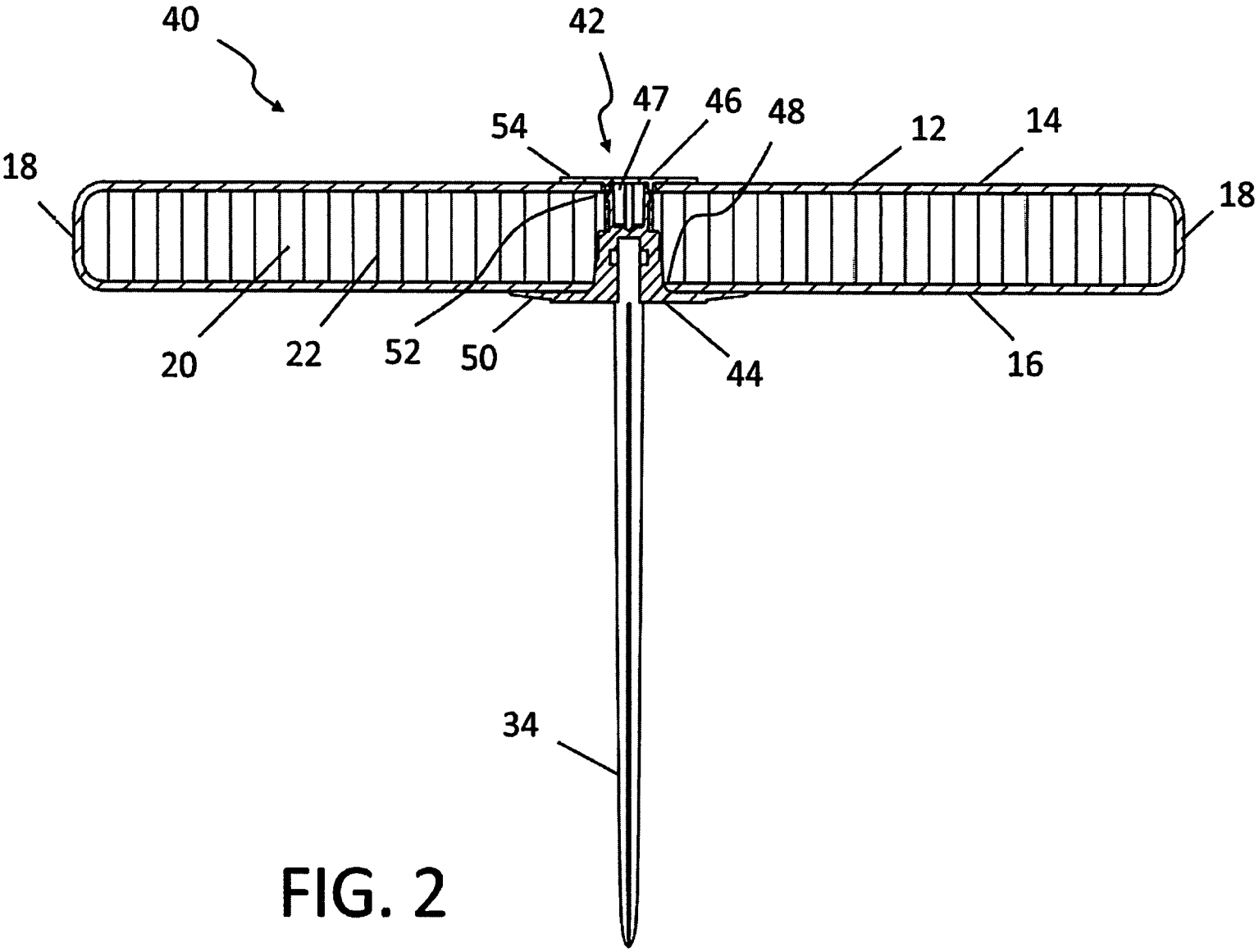
FIG. 2 is a cross-sectional schematic end view of an inflatable member with a pass-through connector according to the techniques of this disclosure.
Figure 3:
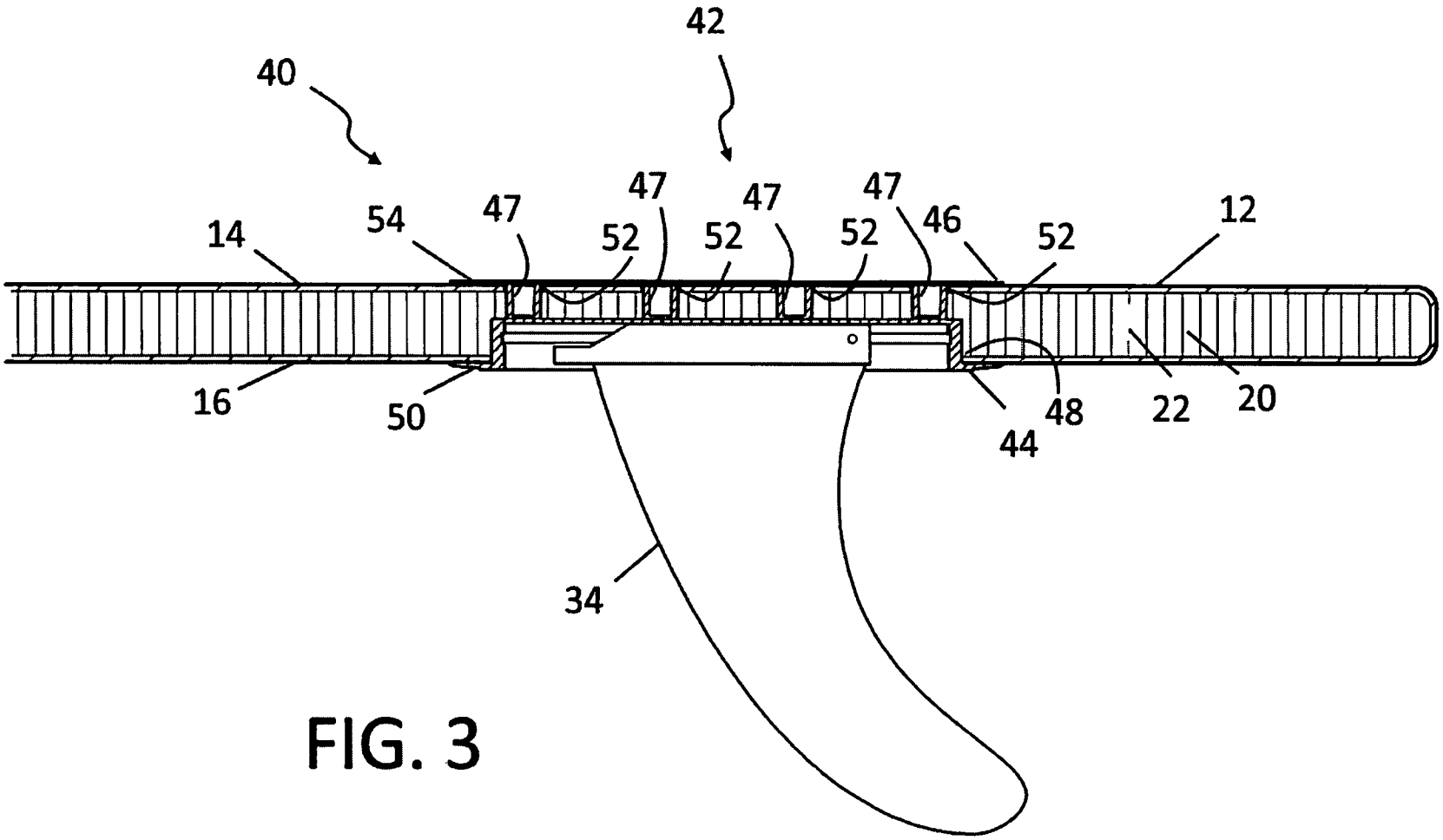
FIG. 3 is a cross-sectional schematic side view of the inflatable member of FIG. 2.
Figure 4:
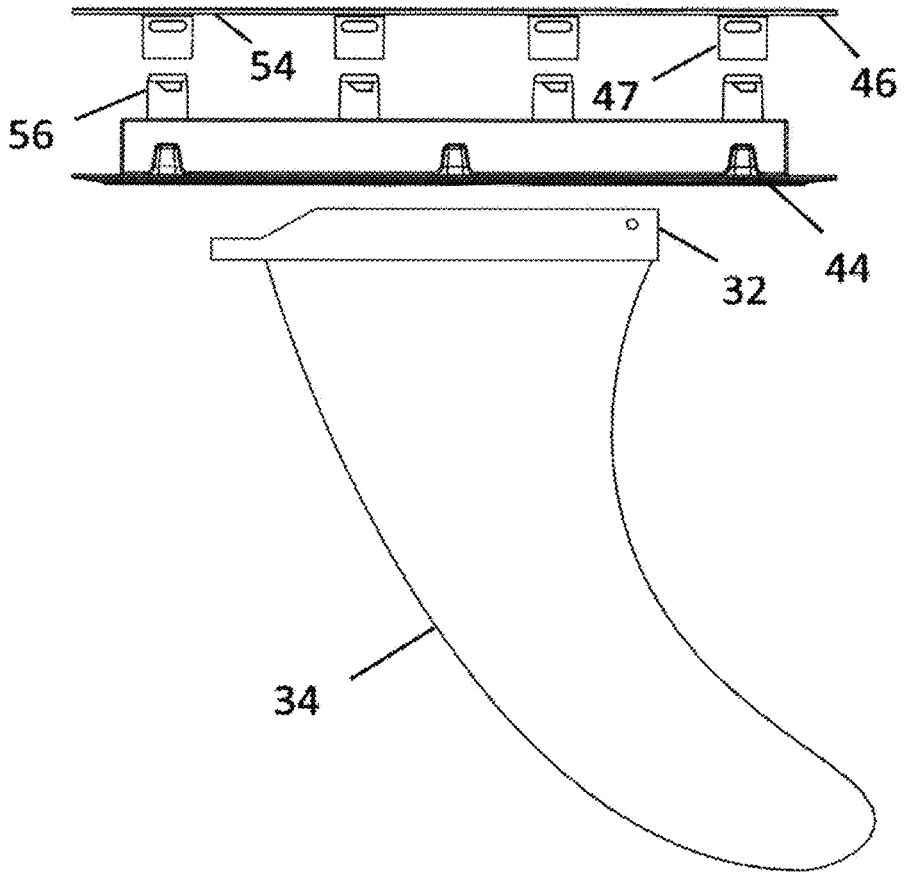
FIG. 4 is an exploded view of the connector of FIGS. 2 and 3.

Another embodiment of this disclosure showing watercraft 40 is depicted in the cross-sectional views of FIGS. 2 and 3, in which similar elements share the same reference numbers. In particular, FIG. 2 is an end view showing an implementation of a multiple part connector 42. Ventral portion 44 of connector 42 defines a receptacle or recess that extends into internal volume 20 of inflatable member 12 as with the previous embodiment. Fin 34 is received by ventral portion 44, but these techniques may be adapted to allow connection of other structural elements or accessories. Dorsal portion 46 of connector 42 includes one or more projections 47 that extend through openings in the opposing surface 14 and engage ventral portion 44. As shown more clearly in the side view of FIG. 3, four projections 47 are employed to interface with one ventral portion 44 in this embodiment, but any suitable number of each can be used in different configurations. Notably, each projection 47 extends through and includes air-impermeable surfaces to maintain the integrity of inflatable member 12 to seal corresponding openings in the respective surfaces of inflatable member. Particularly, ventral portion 44 seals opening 48, with flange 50 overlapping an area of surface 16 adjacent opening 48 as discussed above. Likewise, each projection 47 seals openings 52 in surface 14 with plate 54 acting as a flange as described above. Ventral and dorsal portions 44 and 46 couple to each other within the pressurized internal volume 20. The exploded view of FIG. 4 helps illustrate the interface of ventral portion 44 with dorsal portion 46. Here, projection 47 of dorsal portion 46 interlocks with barrel 56 of ventral portion 44 in a snap-fit connection, but any suitable means of mating the ventral and dorsal portions may be employed as desired. Once ventral and dorsal portions 44 and 46 are coupled together, connector 42 engages both surfaces 14 and 16 of inflatable member thereby greatly increasing the transfer of forces and improving the structural connection. In some embodiments, a continuous air-impermeable surface is created when ventral and dorsal portions 44 and 46 are coupled together. In this embodiment, projections 47 are part of a single dorsal portion 46, coupled by plate 54, however in other embodiments, one or more individual elements can each extend through surface 14 to interlock with a single ventral portion 44 or multiple ventral portions can be employed to interact with a single dorsal portion. Further, the number, spacing and/or sizing of projections 47 can be adapted to match the anticipated structural requirements of the element being connected. Still further, it may be desirable to reduce or avoid interruptions in the drop stich pattern connecting surfaces 14 and 16. Accordingly, the number, spacing and/or sizing of projections 47 or other components of connector 42 can be configured to reduce or avoid such interruptions.

From the above, it will be appreciated that the techniques of this disclosure employ a structural connector that itself seals to the inflatable when installed into the air pressurized area. The connector has a housing that defines a receptacle for receiving a mounting projection such that an exterior surface of the housing is air-impermeable and can be exposed to the pressurized air volume of the inflatable structure. The receptacle is within the profile of the inflatable structure, with the pivot point of the bending moment being beneath the plane extended of the surface of the inflatable. The pivot point can even extend entirely through the inflatable structure, and beyond to sit above the opposite surface sealing with the other side, thereby offering another connection point, or a way to interact with the connection on the opposite side of the structure.

Incorporating the connector into the inflatable member requires a very small hole or opening to be created in the surface(s), just large enough for the bulk of the connector to pass and no larger. A sealing flange that is built into the connector mates and is bonded with the surface of the inflatable structure. The connector may be made of a polymer that is easily bonded or welded to the rubber coated inflatable fabric to create a durable lasting seal to hold the air pressure. TPU, ABS, PC, PMMA and PVC are suitable polymers for bonding to rubber polymer coated inflatable fabrics. In another embodiment, this connector could pass entirely through the air chamber and small hole(s) could be made on the opposite side of the connector to allow for secondary pieces of the structural connector that engage and lock with the connector in a way that offers enhanced structural benefits from connecting to the opposite side of the inflatable structure. A connector that interacts with opposing surfaces of the inflatable increases the connectors resistance to twisting and any loads creating bending moments. The opposite side of the inflatable is being utilized to help the inflatable structure avoid deflection of the surfaces. The connector could also utilize the opposite side of the structure for another connection point. In multiple piece embodiments, the structural connector that integrates with opposing sides of the inflatable positively lock together from either side during installation, reducing the size of hole necessary to install. During manufacture, some air pressurization of the inflatable allows the opposing inflatable surfaces to mate with the flanges on the structural connector to create a durable bond between the inflatable and the flanges on both sides of the structural connector. Correspondingly, once the flange(s) of the connector are bonded to the surface(s), the connector seals any openings, either in one surface or in opposing surfaces. Curing of the adhesives then withstands the high working pressures applied to the inflatable panel or beam.

Characteristics of the connectors of this disclosure include allowing the pivot of the bending moment of the apparatus engaged with connector to be below the surface of the inflatable. The connector does not require a large pre-sealed hole to be built into the inflatable, simplifying the construction considerably, and reducing overall weight of the structure required. Furthermore, if the structure interacts with the opposite side of the inflatable, the load capabilities are increased substantially. For example, deflection of the fins on a surfboard is known to reduce performance dramatically, so the inherent stiffness of the pass-through two-part locking connector increases performance over the surface mount connector significantly. The two-part connector that passes through the inflatable entirely also offers more connection options on the opposing side, or could allow an axle or arm to pass through the connector and operate something on the other side of the inflatable structure, while holding the axle firmly in place. The inflatable structure defines at least one continuous surface (planar or having a consistent radius of curvature that may be concave or convex), such that the connector occupies an opening formed in that surface, creating a sealing engagement that retains the pressurized air volume. The connector components can be made of rigid materials to improve the structural properties of the interface while still effectively transferring forces to the flexible material forming the membrane of inflatable.

Additionally, the configuration of the connector interacts with the inflatable member in such a way as to allow the end of the extended arm of the connected part to end below the surface of the inflatable, allowing most of the structure to be positioned behind the surface of the inflatable, reducing the interference with the surface of the inflatable, especially in the area around the connector, and allows for the structural connector to pass through anywhere on the surface, even close to, or on the edges. One example is in the case of the surfboard, in which the side fins need to be very close to the rail, and these techniques allow placement close to the edge. In comparison, using a conventional sealed "doughnut" hole that is large enough to connect a fin is too interruptive of the inflatable and does not allow for connectors that are large, or near the edges of the inflatable. Furthermore, the integrated structural connector interacts with the inflatable structure's surfaces more directly, without the need for the doughnut hole or cover plates, and this creates a more structurally rigid connection point with far less weight added to the structure.

Figure 5:
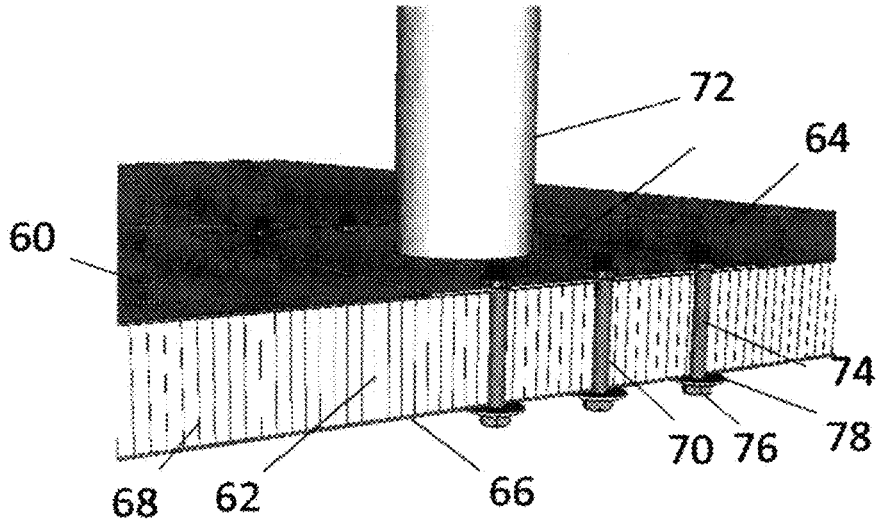
FIG. 5 is a schematic view of pass through connectors for securing a structural element to an inflatable panel, according to the techniques of this disclosure.

The techniques of this disclosure can also be modified to permit other types of connections between inflatable members and structural elements. For example, FIG. 5 schematically depicts connection of a primarily perpendicular structural member, secured to an inflatable membrane drop stitch panel using pass-through connectors. As shown, inflatable panel 60 has an internal volume 62 defined by opposing surfaces 64 and 66 that may be pressurized. Drop stitches 68 extend between surfaces 64 and 66. Pairs of corresponding openings are formed in surfaces, with a pass-through connector 70 extending through each pair. Although six pairs of openings and six connectors 70 are shown in this view but any suitable number can be employed depending on the desired performance. Structural member 72 has flange 74 to provide a bearing area on one side of the drop stitch panel 60. Flange 74 may also be bonded, welded, adhered, or otherwise secured to the panel in addition to the pass-through connectors. Pass-through connectors 70 are configured to provide a sealing engagement with the opposing surfaces 64 and 66 of panel 60 in order to maintain the airtight integrity of the panel when inflated. For example, pass-through connectors 70 have a tubular bore 74 defining a recess or passage within the internal volume of panel 60, through which suitable fasteners 76, such as bolts or the like, may pass. The tubular bore 74 may be formed from any desired material, and in some embodiments, may be rigid so that it resists compression when the fasteners are tightened. The pass-through connectors 70 may also be surrounded by a resilient material, configured to facilitate a sealing engagement with the surfaces of the panel, which maintains inflatability and flexibility. As shown, the pass-through connectors may engage the opposing side of the panel with washers 78 or by using a fastener head that provides the desired amount of surface area to engage the panel. In other embodiments, a complementary flange may be used on the opposing side of the panel to increase the surface area of the panel that is engaged. One or more elements of connectors 70, such as bore 74, fasteners 76, washers 78 and/or a coating have a sealing surface and are configured to seal the openings in surfaces 64 and 66 through which the connectors pass. In one aspect, the outer diameter of bore 74 presents a surface that is air-impermeable and can be exposed to the pressurized internal volume of panel 60.

Figure 6:
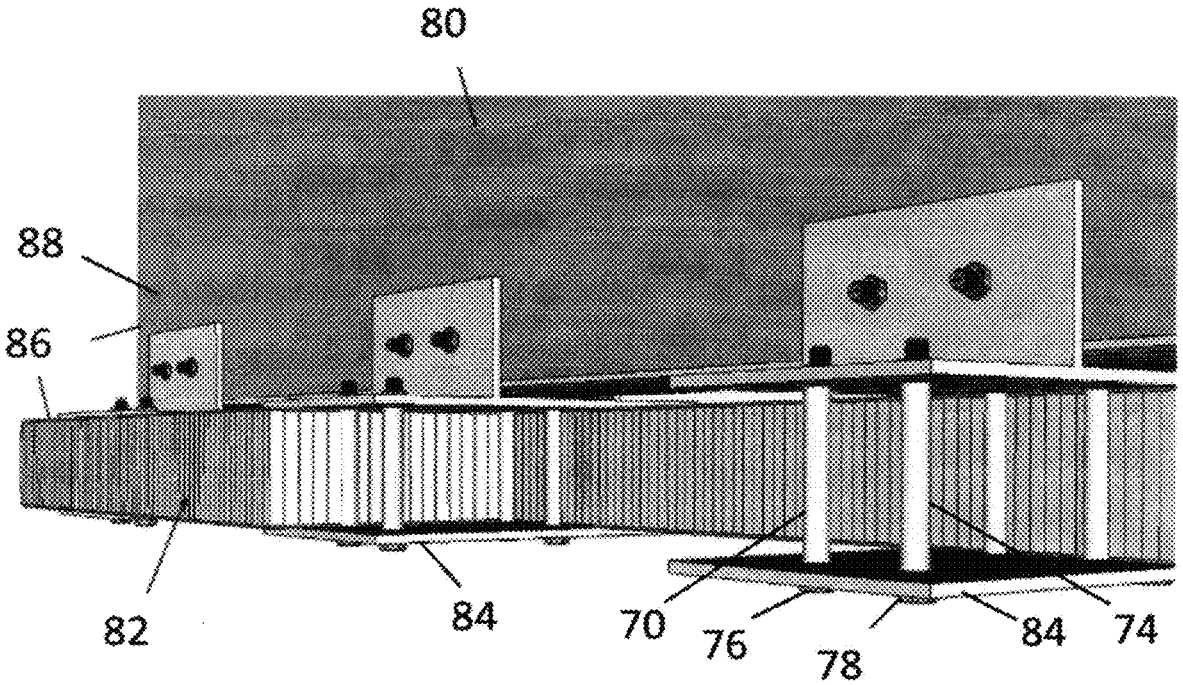
FIG. 6 is a schematic view of pass through connectors for securing inflatable panels together, according to the techniques of this disclosure.

Similar techniques can also be used to join multiple inflatable members, with one illustrative example shown in FIG. 6. In this embodiment, two inflatable panels 80 and 82 are secured together with right angle brackets 84 than are sized for the thickness of panels 80 and 82 to interface with the surfaces 86 and 88 of the respective panels. Other embodiments may involve the panels meeting at other angles, such as 45°, but in general, any angle may be used depending on the application. Similarly, the panels can also be secured to each other with a butt joint in a co-planar arrangement. Brackets 84 are secured to panels 80 and 82 using pass through connectors 70 as described above. Notably, one or more elements of connectors 70, such as bore 74, fasteners 76, washers 78 and/or a coating are employed to seal all openings through which the connectors pass to maintain the integrity of the panels 80 and 82, allowing their respective internal volumes to be pressurized.

Described herein are presently preferred embodiments, however, one skilled in the art that pertains to the present invention will understand that there are equivalent alternative embodiments. In particular, the connectors for inflatable members are particularly suited for recreational products, floating inflatable structures, inflatable flying structures, inflatable home products, inflatable buildings, portable, structural pipes and tubing, aircraft, travel luggage, lightweight, reusable shipping containers and packaging, watercraft, non-inflated structures and buildings and inflatable emergency evacuation chutes.

However, the principles can be used in any suitable application. As such, changes and modifications are properly, equitably, and intended to be, within the full range of equivalence of this disclosure.

The invention claimed is:

1. A connector for an inflatable member comprising a portion configured to extend within an internal volume of the inflatable member and define a recess for accepting a structural connection that is at least partially within the internal volume of the inflatable member and an air-impermeable surface that is configured to maintain integrity of the inflatable member to allow the internal volume to be pressurized when the connector is bonded to an opening in a surface of the inflatable member, wherein the connector is configured to create a pivot point for a bending moment of the structural connection behind the surface of the inflatable member.

2. The connector of claim 1, further comprising a flange configured to overlap the surface of the inflatable member.

3. The connector of claim 1, wherein the connector is configured to engage opposing surfaces of the inflatable member.

4. The connector of claim 3, wherein the connector comprises multiple interlocking portions, including at least one ventral portion that engages one surface of the inflatable member and at least one dorsal portion that engages an opposing surface of the inflatable member.

5. The connector of claim 3, wherein the recess is defined by a tubular bore.

6. The connector of claim 3, further comprising a bracket sized for a width of the inflatable member.

7. The connector of claim 1, wherein the recess is configured to secure a fin tab.

8. The connector of claim 1, wherein the recess is configured to secure a hydrofoil mast.

9. The connector of claim 1, wherein the recess is configured to secure a sail mast.

10. An inflatable member comprising opposing surfaces that define an internal volume that can be pressurized with air, a connector with at least a portion that extends within an internal volume of the inflatable member, wherein the connector defines a recess for accepting a structural connection that is at least partially within the internal volume of the inflatable member and creates an air-impermeable surface that maintains integrity of the inflatable member when the internal volume is pressurized member and wherein the connector is configured to create a pivot point for a bending moment of the structural connection behind the surface of the inflatable member.

11. The inflatable member of claim 10, wherein the inflatable member is configured as a watercraft hull.

12. The inflatable member of claim 11, wherein the recess is configured as at least one of a fin box, a hydrofoil mast receptacle and a sail mast receptacle.

13. The inflatable member of claim 10, wherein the connector engages the opposing surfaces.

14. A method for securing a structural element to an inflatable member, comprising:

forming an opening in a first surface of the inflatable member;

positioning a connector through the opening such that a portion of the connector extends within an internal volume of the inflatable member and defines a recess for accepting the structural element that is at least partially within the internal volume of the inflatable member; and sealing the connector to the surface of the inflatable member;

wherein the connector has an air-impermeable surface that is configured to maintain integrity of the inflatable member to allow the internal volume to be pressurized and member and wherein the connector is configured to create a pivot point for a bending moment of the structural connection behind the surface of the inflatable member.

15. The method of claim 14, further comprising partially pressurizing the internal volume before sealing the connector to the surface to facilitate creation of a bond with the surface.

16. The method of claim 14, further comprising engaging an opposing surface of the inflatable member with the connector.

17. The method of claim 16, further comprising forming an opening in the opposing surface, wherein the connector comprises at least one ventral portion that extends through the opening in the first surface and at least one dorsal portion that extends through the opening in the opposing surface.

* * * * *